United States Patent [19]

Suzuki

[11] 4,110,034

[45] Aug. 29, 1978

[54] DRUM CLEANING APPARATUS FOR ELECTROSTATIC COPYING MACHINE

[75] Inventor: Minoru Suzuki, Tokyo, Japan

[73] Assignee: Ricoh Company, Ltd., Tokyo, Japan

[21] Appl. No.: 800,262

[22] Filed: May 25, 1977

[30] Foreign Application Priority Data

Jun. 24, 1976 [JP] Japan ..... 51/74884

[51] Int. Cl.[2] ..... G03G 21/00

[52] U.S. Cl. ..... 355/15; 15/256.51; 118/652

[58] Field of Search ..... 355/15; 118/652, 657; 15/1.5, 256.5, 256.51, 256.52; 427/18

[56] References Cited

U.S. PATENT DOCUMENTS

| | | | |
|---|---|---|---|
| 3,865,080 | 2/1975 | Hudson | 118/657 X |
| 3,918,808 | 11/1975 | Narita | 355/15 |
| 3,994,725 | 11/1976 | Volkers | 355/15 X |
| 4,006,987 | 2/1977 | Tomono et al. | 355/15 |

*Primary Examiner*—Richard L. Moses
*Attorney, Agent, or Firm*—Frank J. Jordan

[57] ABSTRACT

A magnetic brush cleaning apparatus removes residual toner particles from the periphery of a photoconductive drum after a copying operation. The cleaning apparatus comprises a cylinder which is rotated in close proximity with the drum and a plurality of magnets provided inside the cylinder. The lower portion of the cylinder is immersed in ferromagnetic carrier particles in a carrier container. Due to the force of the magnets, carrier particles adhere to the periphery of the cylinder to form a magnetic brush which brushingly engages with the drum and removes the residual toner particles. A voltage is applied to the cylinder to attract the toner particles to the periphery thereof. The magnets are arranged with their poles spaced in an alternating north and south arrangement relative to the circumference of the cylinder so that the carrier particles are alternatingly attracted and repelled, thereby facilitating movement of the toner particles to the periphery of the cylinder. A carrier scraper blade removes the radially outward carrier particles from the cylinder and guides the same into the carrier container. A toner scraper blade subsequently removes the radially inward toner particles and returns the same to a toner container for recycling.

9 Claims, 2 Drawing Figures

DRUM CLEANING APPARATUS FOR ELECTROSTATIC COPYING MACHINE

BACKGROUND OF THE INVENTION

The present invention relates to a drum cleaning apparatus for an electrostatic copying machine.

In an electrostatic copying machine of the type utilizing a dry development process, a photoconductive drum is electrostatically charged and a light image is radiated onto the surface of the drum to form an electrostatic image through localized photoconduction. A dry toner substance comprising ferromagnetic carrier particles and non-magnetic toner particles is applied to the drum to form a toner image thereon. The toner image is transferred to a copy sheet and fixed thereto to provide a permanent reproduction of the original document. Thereafter, the drum is discharged and residual toner substance removed therefrom.

One of the most effective means for removing the residual toner substance is a magnetic brush. Such a magnetic brush comprises a non-magnetic cylinder which is rotated in close proximity to the drum. Magnets are provided inside the cylinder. Due to the force of the magnets carrier particles, in which the lower portion of the cylinder is immersed, adhere to the cylinder to form a magnetic brush. The magnetic brush brushingly engages with the cylinder to remove the residual toner particles therefrom. Advantages of such a magnetic brush drum cleaning apparatus include high cleaning efficiency and no damage to the drum since the brushing engagement is very light.

However, a problem has heretofore remained unsolved in such a magnetic brush cleaning apparatus in that with prolonged use the proportion of toner particles in the magnetic brush substantially increases. In other words, the toner particles accumulate in the magnetic brush. This causes fatigue of the carrier particles and a deterioration in the cleaning efficiency. In order to prevent double printing which would result from insufficient cleaning of the drum, it has heretofore been necessary to frequently replace the carrier particles in the cleaning apparatus. This constitutes inefficient use of the carrier particles and an excessive maintenance requirement.

SUMMARY OF THE INVENTION

In accordance with the present invention, a magnetic brush cleaning apparatus removes residual toner particles from the periphery of a photoconductive drum after a copying operation. The cleaning apparatus comprises a cylinder which is rotated in close proximity to the drum and a plurality of magnets provided inside the cylinder. The lower portion of the cylinder is immersed in ferromagnetic carrier particles in a carrier container. Due to the force of the magnets, carrier particles adhere to the periphery of the cylinder to form a magnetic brush which brushingly engages with the drum and removes the residual toner particles. A voltage is applied to the cylinder to attract the toner particles to the periphery thereof. The magnets are arranged with their poles spaced in an alternating north and south arrangement relative to the circumference of the cylinder so that the carrier particles are alternatingly attracted and repelled, thereby facilitating movement of the toner particles to the periphery of the cylinder. A carrier scraper blade removes the radially outward carrier particles from the cylinder and guides the same into the carrier container. A toner scraper blade subsequently removes the radially inward toner particles and returns the same to a toner container for recycling.

It is an object of the present invention to provide a magnetic brush drum cleaning apparatus for an electrostatic copying machine which provides superior cleaning efficiency.

It is another object of the present invention to provide a drum cleaning apparatus which eliminates the need for frequent replacement of carrier particles.

It is another object of the present invention to provide a drum cleaning apparatus which prevents deterioration of carrier particles used in the apparatus.

It is another object of the present invention to provide a drum cleaning apparatus which reduces maintenance time and expense over the prior art, thereby effecting substantial economies.

It is another object of the present invention to provide a drum cleaning apparatus which effectively recycles residual toner particles removed from the drum of an electrostatic copying machine after a copying operation.

It is another object of the present invention to provide a generally improved drum cleaning apparatus for an electrostatic copying machine.

Other objects, together with the foregoing, are attained in the embodiment described in the following description and illustrated in the accompanying drawing.

DESCRIPTION OF THE PREFERRED EMBODIMENT

While the drum cleaning apparatus of the invention is susceptible of numerous physical embodiments, depending upon the environment and requirements of use, substantial numbers of the herein shown and described embodiment have been made, tested and used, and all have performed in an eminently satisfactory manner.

Figure 1:
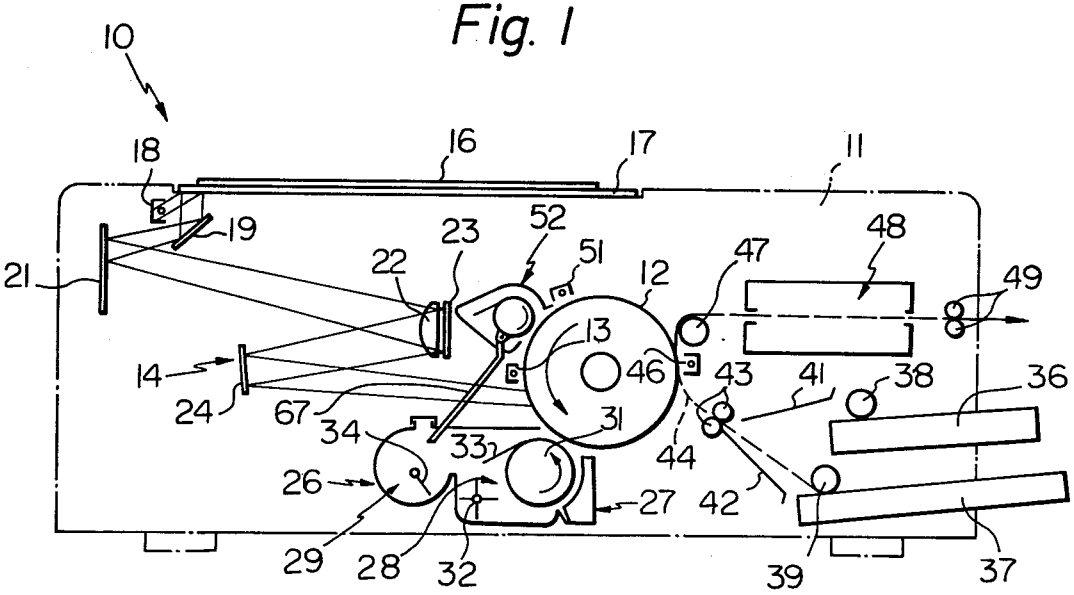
FIG. 1 is a schematic view of an electrostatic copying machine comprising a drum cleaning apparatus embodying the present invention.
Figure 2:
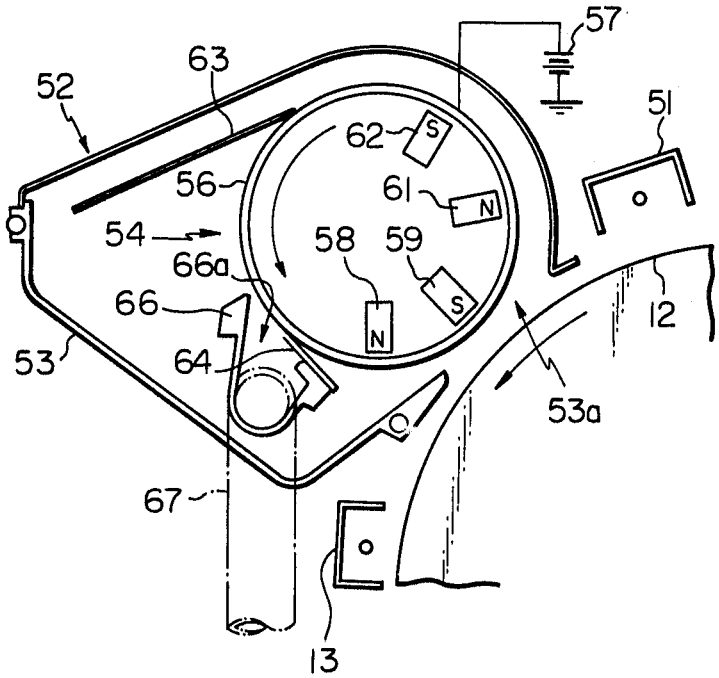
FIG. 2 is a schematic view, to an enlarged scale, of the present drum cleaning apparatus.

Referring now to FIG. 1 of the drawing, an electrostatic copying machine according to the present invention is generally designated by the reference numeral 10 and comprises, mounted inside a housing 11, a photoconductive drum 12 which is rotated counterclockwise at constant speed. Although the component parts of the drum 12 are not the subject matter of the present invention and are not shown in detail, the drum 12 generally comprises a grounded electrically conductive metal core and a photoconductive coating or layer formed on the periphery of the core.

A corona charging unit 13 is provided adjacent to the surface of the drum 12 to apply a uniform electrostatic charge thereto. An exposure unit which is generally designated as 14 radiates a light image of an original document 16 onto the surface of the drum 12 to form an electrostatic image thereon through localized photoconduction. The exposure unit 14 comprises a glass platen 17 on which the document 16 is placed face down. An exposure lamp 18 is mounted below the platen 17 to illuminate a portion of the document 16 therethrough which is immediately above the lamp 18. A light image of this portion is reflected from a plane mirror 19 to a plane mirror 21, from which the image is reflected through a converging lens 22 to a plane mirror 23 which is integrally mounted behind the lens 22. From the mirror 23, the image is again reflected through the lens 22 to a plane mirror 24 from which the image is reflected onto the drum 12. It will be noted that the image is refracted twice by the lens 22, the focal length of which is selected to focus the image on the drum 12.

The document is scanned by moving the lamp 18 and mirror 19 rightwardly in a unitary manner at the same surface speed as the drum 12. The mirror 21 is also moved rightwardly, but at one half the surface speed of the drum 12. As an alternative arrangement, the lamp 18 and mirrors 19 and 21 may be held stationary and the document 16 moved at the same surface speed as the drum 12.

A developing unit 26 applies a toner mixture or substance consisting of ferromagnetic carrier particles and resinous, black colored toner particles onto the surface of the drum 12 to develop the electrostatic image and form a toner image. The developing unit 26 comprises a developing tank 27 having a toner mixture compartment 28 in which a cylinder 31 is rotated counterclockwise at constant speed in close proximity to the drum 12. The toner mixture is provided in the compartment 28 to a depth such that the lower portion of the cylinder 31 is immersed therein. An agitator 32 is driven for rotation to homogenize the toner mixture in the compartment 28.

The cylinder 31 is hollow and formed of a non-magnetic material. Although not shown, a plurality of magnets are provided inside the cylinder 31. These magnets attract the carrier particles of the toner mixture to the surface of the cylinder 31 to which they adhere, carrying the toner particles therewith. The toner mixture on the cylinder 31 constitutes a magnetic brush which brushingly engages with the drum 12. The toner particles are attracted to the high potential areas of the electrostatic image on the drum 12 and adhere thereto to form the toner image. If desired, the toner particles may be given an electrostatic charge opposite in polarity to the electrostatic image on the drum 12 to facilitate development. The carrier particles are not transferred to the drum 12 but remain on the cylinder 31. These carrier particles are removed from the cylinder 31 after development by a scraper blade 33 and returned to the compartment 28.

The developing tank 27 also has a toner compartment 29 into which is supplied fresh toner particles on a periodic basis. A scoop 34 feeds the toner particles from the compartment 29 into the compartment 28.

Copy sheets of different sizes are provided in cassettes 36 and 37 respectively. Either a feed roller 38 or a feed roller 39 is rotatably driven to feed the copy sheets of the selected size from the cassette 36 or 37 through guides 41 and 42 into the bite or feed rollers 43. As shown, a copy sheet 44 is being fed from the cassette 37 along a path indicated in broken line. The copy sheet 44 is fed in synchronism with the rotation of the drum 12 such that the leading edge of the sheet 44 aligns with the leading edge of the toner image when the sheet 44 is fed into contact with the drum 12 by the feed rollers 43. A corona transfer charger 46 is disposed in such a manner that the copy sheet 44 passes between the drum 12 and transfer charger 46. The transfer charger 46 applies an electrostatic charge of the same polarity as the electrostatic image on the drum 12 but higher in magnitude through the back of the copy sheet 44 so that the toner image is attracted and transferred to the copy sheet 44 from the drum 12. Thereafter, the copy sheet 44 is fed by a feed roller 47 through a fixing unit 48 which fixes the toner image by heat, pressure or a combination thereof, to the copy sheet 44 to provide a permanent reproduction of the original document. Feed rollers 49 discharge the copy sheet 44 out of the housing 10 onto a receiving tray which is not shown.

After the transfer operation a corona discharging unit 51 discharges the drum 12 and a cleaning apparatus 52 of the present invention removes residual toner substance therefrom.

Since it is impossible for all toner to be transferred from the drum 12 to the copy sheet 44, a residual amount remains on the drum 12 which will result in double printing if not removed.

The present cleaning apparatus 52 comprises a carrier particle container 53 which has an opening **53*a* facing the drum 12. A magnetic brush cleaning unit is generally designated as 54 and comprises a non-magnetic hollow cylinder 56 which is rotated counterclockwise at constant speed in close proximity to the drum 12. An attraction voltage source 57 symbolically shown as a battery applies a voltage to the cylinder 56 of a polarity and magnitude such as to attract toner particles to the surface of the cylinder 56. Magnets 58, 59, 61 and 62 are fixedly mounted in the cylinder 56 in a circumferentially spaced arrangement. More specifically, the magnets 58, 59, 61 and 62 are arranged so as to present north and south poles thereof to the inner periphery of the cylinder 56 in an alternating circumferentially spaced manner. A carrier scraper blade 63 had a right edge thereof held in light scraping engagement with the cylinder 56** and slants downwardly from the right edge thereof.

A toner scraper blade 64 has an upper leftward edge thereof also held in scraping engagement with the cylinder 56 but with greater force. The scraper blade 64 defines part of a toner particle container 66 having an opening **66*a* facing the cylinder 56. A pipe 67 leads from the bottom of the toner container 66 into the toner compartment 29 of the developing tank 27**.

Carrier particles are provided in the container 53 to a depth such that the lower portion of the cylinder 56 is immersed therein. Due to the force of the magnet 58, the carrier particles are attracted and adhere to the cylinder 56 to form a magnetic brush which brushingly engages with the drum 12, thereby removing the residual toner particles therefrom by frictional action. Since the poles of the magnets 58, 59, 61 and 62 are provided in an alternating circumferentially spaced arrangement within the cylinder 56, the carrier particles are alternatingly attracted and repelled from the immediate surface area of the cylinder 56, due to temporary magnetism. This facilitates movement of the toner particles due to the voltage applied to the cylinder 56 by the voltage source 57 through the magnetic brush 54 to the immediate surface or periphery of the cylinder 56. Although the net magnetic force on the carrier particles in such as to prevent them from detaching from the cylinder 56, the alternate attraction and repulsion causes slight inward and outward shifting of the carrier particles which allows the toner particles to work their way through the carrier particles to the surface of the cylinder 56. In this manner, when the combined carrier and toner particles reach the scraper blade 63 the carrier particles are radially outward and the toner particles are radially inward.

The force of the scraper blade 63 on the cylinder 56 is selected to be just enough that the radially outward carrier particles are scraped off the cylinder 56 by the scraper blade 63 and slide down the scraper blade 63 under the force of gravity into the bottom of the carrier container 53 for recycling. The toner particles remain on the cylinder 56 and are carried to the scraper blade 64. The removal of carrier particles by the scraper blade 63 is facilitated since no magnets are provided in the vicinity thereof and there is practically no force holding the carrier particles on the cylinder 56.

The force of the scraper blade 64 against the cylinder 56 must be necessarily greater than that of the scraper blade 63 since the scraper blade 64 must remove the toner particles which were not removed by the scraper blade 63. The toner particles are removed from the cylinder 56 by the scraper blade 64 and drop into the toner container 66. From the toner container 66, the toner particles drop down the pipe 67 into the toner compartment 29 of the developing tank 27 for recycling. Preferably the scraper blades 63 and 64 are made of a resilient material such as rubber or plastic. After removal of the toner particles by the scraper blade 64, the cylinder 56 picks up pure carrier particles from the container 53 to form a new magnetic brush.

It will thus be seen that the present drum cleaning apparatus effectively removes residual toner particles from a magnetic brush which removes the toner particles from a photoconductive drum of an electrostatic copying machine. Since the toner particles and carrier particles are separated and recycled, deterioration of the carrier particles is prevented, increasing the copy quality and reducing the maintenance requirements of the copying machine.

Various modifications will become possible for those skilled in the art after receiving the teachings of the present disclosure without departing from the scope thereof.

What is claimed is:

1. In an electrostatic copying machine including a photoconductive member, a cleaning apparatus for removing residual toner particles from the photoconductive member, said cleaning apparatus comprising:

a hollow rotary cylinder disposed closely adjacent to the photoconductive member;

means for producing relative movement between the photoconductive member and the cylinder;

a magnet means disposed inside the cylinder;

a carrier particle container, a lower portion of the cylinder being immersed in ferromagnetic carrier particles provided in the container, the carrier particles adhering to the cylinder due to the force of the magnet means to form a magnetic brush which brushingly engages with the photoconductive member to remove the residual toner particles therefrom;

attraction means for attracting the toner particles to a periphery of the cylinder;

carrier removal means for removing carrier particles from the cylinder; and toner removal means for removing toner particles from the cylinder.

2. A cleaning apparatus as in claim 1, in which the magnet means comprises a plurality of magnets circumferentially spaced adjacent to an inner periphery of the cylinder between the container and the carrier removal means.

3. A cleaning apparatus as in claim 1, in which the attraction means comprises a voltage source for applying a voltage to the cylinder of a polarity and magnitude to attract the toner particles to the periphery of the cylinder.

4. A cleaning apparatus as in claim 1, in which the carrier removal means is constructed to guide carrier particles removed from the cylinder to the container.

5. A cleaning apparatus as in claim 1, in which the carrier removal means comprises a scraper blade operatively engaging with the cylinder.

6. A cleaning apparatus as in claim 4, further comprising a toner container, the toner removal means being constructed to guide toner particles removed from the cylinder to the toner container.

7. A cleaning apparatus as in claim 1, in which the toner removal comprises a scraper blade operatively engaging with the cylinder.

8. A cleaning apparatus as in claim 2, in which the magnets are oriented in such a manner that north and south poles thereof are alternately circumferentially spaced adjacent to the inner periphery of the cylinder respectively so as to apply alternating radially inward and outward forces to the carrier particles on the cylinder and facilitate movement of the toner particles to the periphery of the cylinder.

9. A cleaning apparatus as in claim 6, in which the toner container is provided inside the carrier particle container.

* * * * *